United States Patent [19]

Yasuhara

[11] Patent Number: 4,615,316

[45] Date of Patent: Oct. 7, 1986

[54] CONTROL METHOD AND APPARATUS FOR PROTECTING ENGINE FROM EXCESSIVE WEAR AND THE LIKE

[75] Inventor: Seishi Yasuhara, Yokosuka, Japan

[73] Assignee: Nissan Motor Co., Ltd., Yokohama City, Japan

[21] Appl. No.: 629,417

[22] Filed: Jul. 10, 1984

Related U.S. Application Data

[63] Continuation-in-part of Ser. No. 569,494, Jan. 9, 1984, abandoned.

[30] Foreign Application Priority Data

Jan. 10, 1983 [JP] Japan ..... 58-1418[U]

[51] Int. Cl.[4] ..... F02B 77/08

[52] U.S. Cl. ..... 123/333; 123/198 DB; 123/41.15; 123/351; 123/478; 123/340

[58] Field of Search .... 123/198 D, 198 DB, 198 DC, 123/41.15, 333, 478, 351, 352, 340

[56] References Cited

U.S. PATENT DOCUMENTS

| | | | |
|---|---|---|---|
| 3,570,460 | 3/1971 | Rabus | 123/333 |
| 3,736,910 | 6/1973 | Raff | 123/333 |
| 3,841,291 | 10/1974 | Ludewig et al. | 123/41.15 |
| 4,094,274 | 6/1978 | Harada et al. | 123/198 DB |
| 4,099,495 | 7/1978 | Kiencke et al. | 123/198 DC |
| 4,117,815 | 10/1978 | Ikeura | 123/489 |
| 4,375,207 | 3/1983 | Sieben et al. | 123/198 DB |

*Primary Examiner*—Ira S. Lazarus

*Attorney, Agent, or Firm*—Schwartz, Jeffery, Schwaab, Mack, Blumenthal & Evans

[57] ABSTRACT

In order to prolong the life of the engine the maximum temperature and engine speed thereof are limited in accordance with the temperature of the engine coolant by controlling the amount of fuel supplied to said engine. During "running-in" of the engine the maximum temperature and engine speed limits are gradually increased until a predetermined amount of distance has been traversed by the vehicle in which the engine is disposed.

12 Claims, 6 Drawing Figures

CONTROL METHOD AND APPARATUS FOR PROTECTING ENGINE FROM EXCESSIVE WEAR AND THE LIKE

This application is a continuation-in-part of U.S. patent application Ser. No. 569,494 filed on Jan. 9, 1984 now abandoned in the name of Seishi Yasuhara.

BACKGROUND OF THE INVENTION

1. Field of the Invention

The present invention relates generally to an internal combustion engine and more specifically to a method and apparatus for automatically controlling the engine in a manner to prevent same from operating at excessively high temperatures and engine speeds.

2. Description of Related Art

In order to prevent engine damage due to operating same at excessively high temperature and/or engine speeds it is common to provide warning lamps and/or tachometers on the instrument panel of the vehicle in which the engine is mounted. This enables the driver of the vehicle to suitably control the vehicle in the event he or she becomes aware of the abnormal condition.

However, this type of control has not satifactorily prevented excessive wear occuring, especially during "running-in" of the engine, nor the rapid deterioration of the engine lubricant which occurs when the engine is operated at excessively high temperatures and speeds. This is especially so in the case of diesel engines which are particularly prone to the above mentioned problems due to the high compression ratios at which they operate.

SUMMARY OF THE INVENTION

It is an object of the present invention to obviate excessive engine wear and/or damage via automatic engine control.

In brief, the present invention features an arrangement wherein in order to prolong the life of the engine and the lubricant used therein, the maximum temperature and engine speed thereof are limited by controlling the amount of fuel supplied to said engine in accordance with with the temperature of the engine coolant. During "running-in" of the engine the maximum temperature and engine speed limits are gradually increased until a predetermined amount of distance has been traversed by the vehicle in which the engine is disposed. During idling of the engine, the engine speed is raised in the event that excessive temperatures are encountered to improve coolant circulation and therefore cooling efficiency.

More specifically, a first aspect of the present invention takes the form of a method of operating an internal combustion engine including the steps of: sensing the temperature of the engine coolant, and protecting said engine from damage and/or excessive wear by controlling the amount of fuel supplied to said engine in accordance with the sensed engine coolant temperature and therefore limiting the maximum temperature and engine speed of said engine to predetermined limits.

A further aspect of the present invention comes in the form of an internal combustion engine including a coolant sensor and a control arrangement responsive to the output of the temperature sensor for controlling the amount of fuel supplied to the engine, the control circuit being arranged to limit the maximum temperature and engine speed of the engine in a manner to prevent damage and/or excessive wear.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Figure 1:
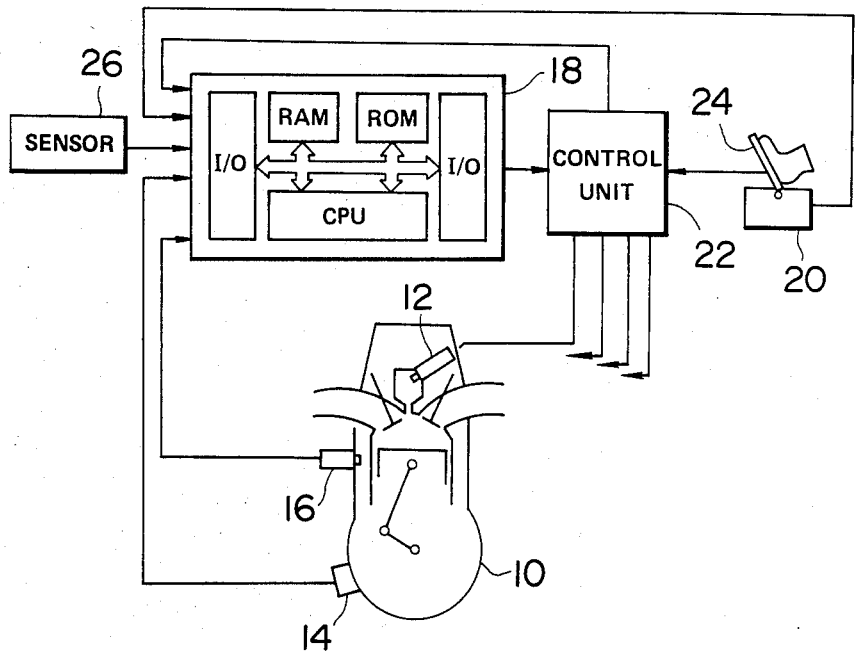
FIG. 1 is a schematic diagram showing an internal combustion engine equipped with a microprocessor which controls the engine in accordance with the present invention.

FIG. 1 shows an internal combustion engine 10 (which by way of example takes the form of a diesel engine) equipped with a fuel injector 12, an engine speed sensor 14, a coolant sensor 16, and a microprocessor 18 which receives inputs from the engine speed sensor 14 and coolant temperature sensor 16 and an accelerator pedal position sensor 20. A control output of the microprocessor 18 is fed to a fuel injection control unit 22 (including a fuel pump) which is operatively connected with the accelerator pedal 24. The microprocessor 18 further receives inputs from a circuit 26 such as an odometer, indicating (a) the total distance traversed by the vehicle (not shown) in which the engine 10 is mounted, and from the fuel injection control unit 22 indicating (b) the actual amount of fuel being injected. This latter mentioned input may, by way of example, take the form of the injection control signal pulse width in the case of a gasoline engine or a signal indicative of the position of a fuel injection pump drain port sleeve valve, in the case of a diesel engine.

As shown, the microprocessor 18 includes a RAM, a ROM and a CPU operatively interconnected with the sensors 14, 16, 20 and 26 and the fuel injection control unit 22 via input and output interfaces I/O.

Figure 2:
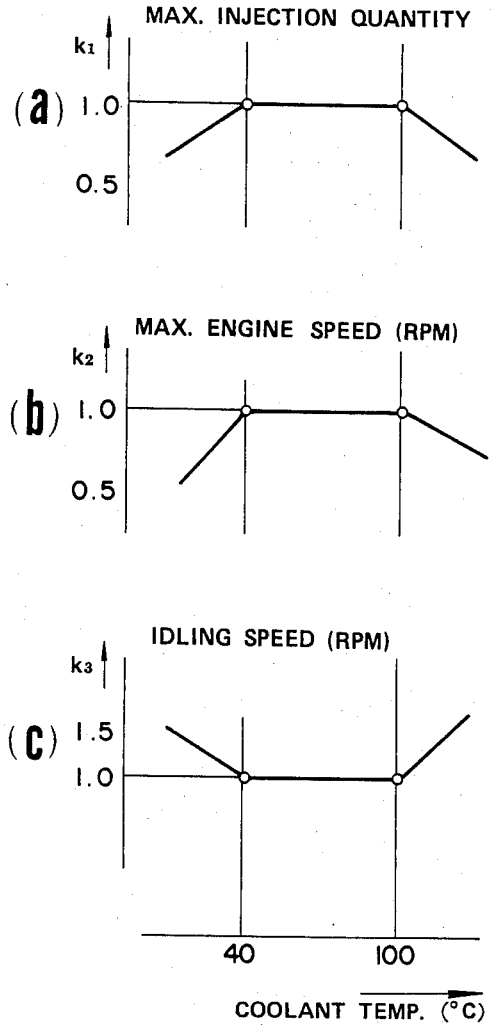
FIGS. 2(*a*), 2(*b*) and 2(*c*) respectively show, in graphical form, a maximum fuel injection control schedule, a maximum engine speed control schedule and an engine idling control schedule (all as a function of engine coolant temperature) which characterize an embodiment of the present invention.
Figure 3:
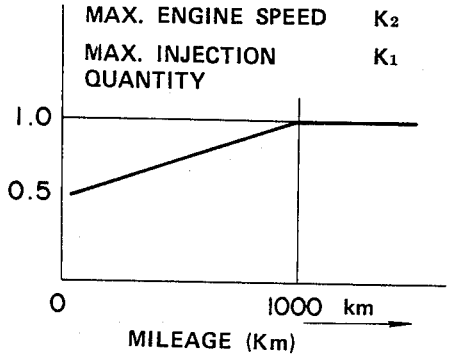
FIG. 3 shows in graphically form a "running-in" control schedule according to the present invention.

In this embodiment the ROM contains the control schedules shown in FIGS. 2(*a*), (*b*), (*c*) and 3, in the form of look-up tables. In the case of the tables shown in FIGS. 2(*a*)–(*c*) the X-axis is graduated in terms of engine coolant temperature while on the Y-axis thereof is plotted a factor by which the normal injection or engine speed should be modified for any given temperature within the plotted range. On the other hand in the table of FIG. 3, the abscissa is calibrated in terms of vehicle mileage while the ordinate is calibrated in terms of a factor which which the maximum engine speed and temperature should be modified during running-in. In this example, the factor varies from 0.5 to 1.0.

Figure 4:
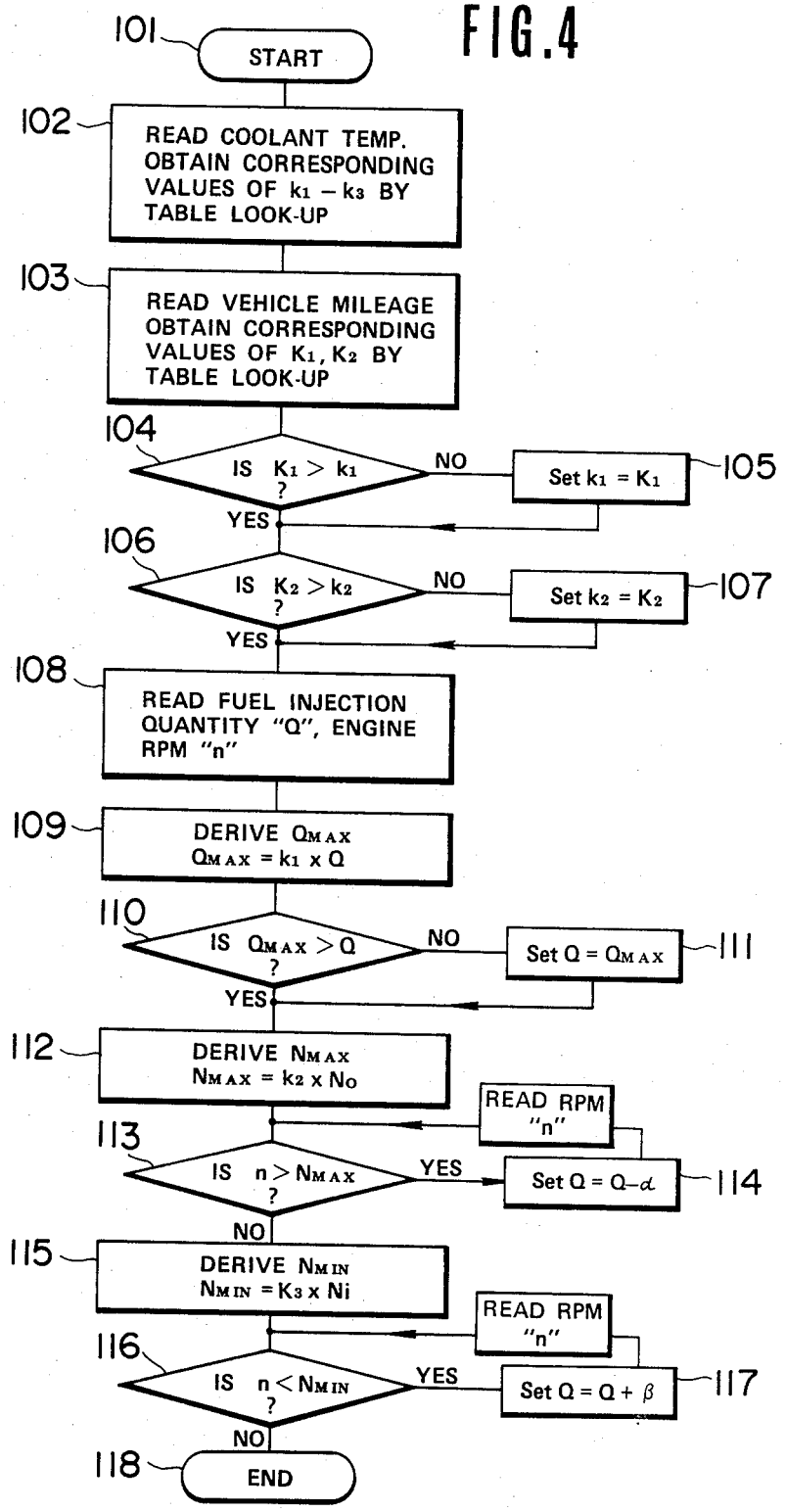
FIG. 4 is a flow chart showing the steps which characterize an embodiment of the invention implemented via microprocessor or like device.

FIG. 4 shows in flow chart form the characterizing steps of a program which utilizes the data contained in the above mentioned four tables and via which the fuel injection controlled unit is controlled.

As shown, following the START of the program in step 101, the program proceeds in step 102, to read the instantaneous value of the engine coolant temperature and obtain, via table look-up, the corresponding values of factors $k_1$–$k_3$. In step 103 the program reads the vehicle mileage and determines the corresponding values of $K_1$ and $K_2$ via table look-up. Of course if the vehicle has run more than 1000 Km (for example) the values of both $K_1$ and $K_2$ will both be "1".

In step 104 the program determines if $K_1$ is greater than $k_1$. If the answer to this inquiry is NO, the program in step 105, sets the value of $k_1$ equal to $K_1$ so as to suitably reduce the amount of fuel injected during the "running in" period and proceeds to step 106. If the answer to the inquiry made at step 104 is YES, then the program proceeds directly to step 106 wherein $K_2$ is compared with $k_2$. If the result of this comparison indicates that $k_2$ is larger than $K_2$ then the program goes to step 107 wherein the value of $k_2$ is set equal to the lower of the two values, i.e. to $K_2$ for "running in".

In step 108 the instantaneous fuel injection quantity "Q" and engine speed "n" are read. In step 109 the maximum amount of fuel ($Q_{max}$)which should be injected is derived using the equation $Q_{MAX}=k_1\times Q_0$ (where $Q_0$ is the maximum possible injection quantity) and compared in step 110 with the actual value (Q). If the outcome of this comparison indicates that the amount of fuel being injected (Q) is greater than the derived value ($Q_{max}$) the program reduces the amount of fuel to be injected to a value corresponding to the derived one. However, if in the instance the quantity of fuel (Q) being injected is less than the derived value ($Q_{max}$) the program maintains the injection quantity as is and proceeds to step 112 wherein the maximum engine speed $N_{max}$ is derived. It should be noted that $N_0$ in the equation $N_{MAX}=K_2\times N_0$ is the maximum permissible engine speed.

In step 113 the actual engine speed "n" is compared with the drived value. In the event of this comparison indicates that the "n" is greater than the derived $N_{max}$ value the program proceeds to step 114 wherein the injection quantity (step 111) is reduced incrementally as shown, and returns to step 113. This loop is maintained until such time as the instantaneous "n" value becomes equal to or slightly less than the derived $N_{max}$ value.

At step 115 the minimum engine speed (viz,. that required during idling) is derived, it being noted that "$N_i$" indicates the lowest RPM at which the engine can operate stably. In the event that the engine is idling and the instanteous engine speed "n" is below the derived value, the injection quantity is increased incrementally as shown in step 117 until the appropriate engine idling is acheived. This increase in idling speed increases the rate at which water or like coolant is circulated about the engine proper and therefore increases the cooling efficiency thereof. However, in the case of an engine wherein the engine coolant is not circulated by a water pump and the cooling efficiency of the engine is not increased by the increased idling speed, then the steps 115, 116 and 117 should be omitted.

The program terminates in step 118 and returns to step 101.

Thus, it will be understood that with the invention, by controlling a given parameter such as the amount of fuel fed to the engine, the maximum temperature and speed of the engine can be controlled in a manner to obviate excessive wear and damage to either the engine or the lubricant. Of course with the deterioration of the engine lubricant engine wear will tend to increase irrespective of the temperature and engine speed. Accordingly, as the present invention constantly monitors the engine temperature and speed, the deterioration of the engine lubricant is slowed, synergistically adding to the expected life-prolonging effects of the control which characterizes the present invention.

It will be understood that other methods of reducing engine speed and temperature fall within the scope of the present invention which is not necessarily limited to fuel quantity control. For example, one or more cylinders of the engine may be rendered inoperative via fuel cut-off during deceleration and/or idling, ignition timing control, turbocharger waste gate control or the like, in addition to the disclosed fuel injection control method.

What is claimed is:

1. A method of operating an internal combustion engine of a vehicle comprising the steps of:

(a) sensing the temperature of the engine coolant;

(b) automatically sensing the distance traversed by the vehicle; and (c) limiting the maximum amount of fuel which may be supplied to the engine in accordance with a schedule which varies the amount of fuel injection in accordance with the temperature of the engine coolant and the distance traversed by the vehicle.

2. A method as claimed in claim 1, wherein step (c) comprises:

(i) deriving a first fuel supply modification factor as a function of the temperature sensed in step (a);

(ii) deriving a second factor which varies as a function of the distance traversed by said vehicle;

(iii) comparing the first and second factors and adjusting the first factor to equal the second factor in the event that the second factor is less than the first factor;

(iv) deriving a value indicating the maximum amount of fuel which should be supplied to the engine by multiplying an amount actually being supplied to said engine by said first factor;

(v) comparing the derived value with the actual amount; and (vi) reducing the actual amount of fuel supplied to the engine to the derived value in the event that the actual amount being supplied is greater than the derived value.

3. A method as claimed in claim 1, further comprising the steps of:

(i) circulating the engine coolant within a coolant jacket formed around the engine using a circulation pump driven by the engine;

(ii) sensing the engine idling;

(iii) sensing if the temperature of the engine coolant is above a maximum permissible limit; and (iv) increasing the amount of fuel supplied to the engine during idling if said engine coolant temperature is above the predetermined limit so as to increase the engine revolution speed and increase the rate at which the coolant is circulated within the coolant jacket by said coolant circulation pump.

4. A method as claimed in claim 3, further comprising the steps of:

(a′) deriving a third engine speed modification factor as a function of the temperature sensed in step (a);

(b′) deriving a fourth factor which varies in accordance with the distance traversed by said vehicle;

(c') comparing said third and fourth factors and adjusting said third factor to equal said fourth factor in the event that said fourth factor is less than said third factor;

(d') deriving a maximum engine speed by multiplying an actual engine speed by said third factor;

(e') comparing the actual engine speed and the derived engine speed;

(f') reducing the amount of fuel supplied to said engine in the event that the actual engine speed is greater than the derived speed; and (g') repeating steps (c') and (f') until the actual engine speed is equal to or less than the derived speed.

5. An internal combustion engine for a vehicle comprising:

an air-fuel mixture forming device;

a fuel supply arrangement for supplying fuel to said air-fuel mixture forming device;

a manually operable member operatively connected with said fuel supply arrangment for providing a signal indicative of the amount of fuel to be supplied to said air-fuel mixture forming device;

means for producing a signal indicative of the distance traversed by said vehicle;

an engine coolant temperature sensor;

an engine speed sensor; and a control unit for controlling the amount of fuel supplied to the engine in response to said manually operative member, said producing means, said engine coolant temperature sensor and said engine speed sensor.

6. An internal combustion engine as claimed in claim 5, wherein said control unit comprises a microprocessor including a RAM, ROM and CPU, said ROM containing a predetermined control schedule in the form of a look-up table.

7. An internal combustion engine as claimed in claim 6, wherein said look-up table takes the form of a maximum fuel supply quantity control schedule indicating a factor by which the actual momentary supply quantity should be modified as a function of the engine coolant temperature, said maximum fuel supply quantity control schedule including a first section wherein the factor increases with increase in coolant temperature, a second section wherein the factor remains constant between a first and a second predetermined coolant temperature and a third section wherein said factor decreases with increase in coolant temperature above said second predetermined coolant temperature.

8. An internal combustion engine as claimed in claim 6, wherein said look-up table takes the form of a maximum engine speed control schedule indicating a factor by which the engine speed should be modified as a function of engine coolant temperature, said maximum engine speed control schedule including a first section wherein said factor increases with increase in coolant temperature, a second section wherein said factor remains constant between a first and a second predetermined engine coolant temperature and a third section wherein said factor decreases with increase in coolant teperature above said second predetermined temperature.

9. An internal combustion engine as claimed in claim 6, wherein said look-up table takes the form of a minimum idling speed control schedule indicating a factor by which the idling speed of the engine should be modified as a function of engine coolant temperature, said idling control schedule including a first section wherein the factor decreases with increase in coolant temperature, a second section wherein said factor remains constant between a first and a second predetermined coolant temperture and a third section wherein said factor increases with increase of coolant temperature above said second predetermined temperature.

10. An internal combustion engine as claimed in claim 6, wherein said look-up table takes the form of a running-in control schedule indicating a factor by which the maximum fuel injection quantity and engine speed should be modified, said schedule including a first section wherein said factor increases with increase in distance traversed by said vehicle and a second section wherein said factor remains constant above a predetermined distance.

11. An internal combustion engine as claimed in claim 5, further comprising a coolant circulation pump which is driven by said engine and which circulates the engine coolant through a coolant jacket disposed around said engine; and wherein said control circuit includes means responsive to said engine coolant temperature sensor and said engine speed sensor for determining whether the engine is in an idling state and whether the temperature of the engine coolant is above a predetermined maximum permissible limit, said responsive means increasing the amount of fuel supplied to the engine when the engine is in an idling state and the engine coolant temperature is above the predetermined maximum permissible limit so as to increase the engine revolution speed and thus increase the rate at which coolant is circulated by said coolant ciruclation pump.

12. An internal combusiton engine as claimed in claim 5, wherein said manually operative member is an accelerator pedal.

* * * * *